US006505791B1

(12) United States Patent
Syndikus et al.

(10) Patent No.: US 6,505,791 B1
(45) Date of Patent: Jan. 14, 2003

(54) THREAD TRAVERSING DEVICE

(75) Inventors: Heike Syndikus, Guben (DE); Marc Schaad, Lenzburg (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/719,255

(22) PCT Filed: Jun. 10, 1999

(86) PCT No.: PCT/CH99/00253

§ 371 (c)(1),
(2), (4) Date: Apr. 4, 2001

(87) PCT Pub. No.: WO99/65810

PCT Pub. Date: Dec. 23, 1999

(30) Foreign Application Priority Data

Jun. 12, 1998 (CH) ..... 1278/98
Nov. 11, 1998 (CH) ..... 2267/98

(51) Int. Cl.[7] ..... B65H 54/28; B65H 65/00

(52) U.S. Cl. ..... 242/477.2; 242/475.7; 242/476.2; 242/478.2; 242/481.2

(58) Field of Search ..... 242/477.2, 478.2, 242/483.9, 476.2, 476.3, FOR 146, 480.8, 157.1, 475.7, 481.2

(56) References Cited

U.S. PATENT DOCUMENTS

| | | | | |
|---|---|---|---|---|
| 2,345,544 A | | 3/1944 | Worthington | |
| 3,094,292 A | * | 6/1963 | Hebberling | 242/472.8 |
| 3,858,816 A | * | 1/1975 | Corbiere | 242/165 |
| 4,325,517 A | | 4/1982 | Schippers et al. | |
| 4,555,069 A | | 11/1985 | Maeda et al. | |
| 4,899,529 A | * | 2/1990 | Fumio | 242/481.4 |
| 5,275,843 A | | 1/1994 | Hirano | |
| 5,605,295 A | | 2/1997 | Klee | |
| 5,676,324 A | | 10/1997 | Miyagawa | |
| 5,794,868 A | | 8/1998 | Busenhart et al. | |
| 5,908,170 A | * | 6/1999 | Kunz | 242/477.3 |
| 6,311,919 B1 | * | 11/2001 | Hermanns et al. | 242/477.3 |

FOREIGN PATENT DOCUMENTS

| | | | |
|---|---|---|---|
| CH | 153167 | | 3/1932 |
| DE | 1131575 | | 12/1962 |
| DE | 44 24 468 A1 | * | 1/1996 |
| DE | 196 23 771 A1 | * | 12/1997 |
| EP | 0012937 | | 7/1980 |
| EP | 0 311 827 | * | 4/1989 |
| EP | 0453622 | | 2/1995 |
| EP | 829 444 A1 | * | 3/1998 |
| EP | 838 422 A1 | * | 4/1998 |
| EP | 0894876 A1 | | 2/1999 |
| GB | 1 377 638 | * | 12/1974 |
| JP | 7137934 | | 5/1995 |
| JP | 7165368 | | 6/1995 |
| WO | WO 92/08664 | * | 5/1992 |
| WO | WO 99/05055 | * | 2/1999 |

OTHER PUBLICATIONS

EPO Search Report, Aug. 26, 1999.
German Search Report, Jul. 7, 1999.
Patent Abstract of Japan No. 08217332, Aug. 27, 1996.

* cited by examiner

*Primary Examiner*—Michael R. Mansen
(74) *Attorney, Agent, or Firm*—Dority & Manning

(57) ABSTRACT

A textile machine thread traversing device includes a traversing arm and a holding device to retain the arm as it moves in a back and forth motion. A drive mechanism is connected to the holding device to rotate the holding device relative to a turning axis. A programmable control system is configured with the drive mechanism and includes a detecting device disposed to detect the angular position of the traversing arm and to control the drive mechanism as a function of the angular position.

18 Claims, 5 Drawing Sheets

THREAD TRAVERSING DEVICE

The present invention relates to traversing with a thread guide which has to be moved over a pre-definable stroke length, in particular when the thread guide is furnished on a rotatable supported arm in the form of a rotatable supported arm respectively.

BACKGROUND

The basic principle is very old.

The arm, which can be called a "pointer", was already in an earlier solution and arranged rotatable or pivotable and drivable respectively, and on the other end it was form in such a way that it could guide the thread in a controlled manner. Such an arm is known from the Swiss patent CH 153 167 and from the German patent DE-C-11 31 575. In the CH 153 167, the arm is provided on its free end with a fork-shaped slot for guiding a thread and on the other end it is rotatably supported. The drive is accomplished through a mechanical driving connection derived from the drive of the bobbin. The thread is guided over a guide rod, whereat the geometry of the arrangement of fixed guide rod, in relation to the increasing diameter of the packing during bobbin travel, is supposed to lead to a stroke reduction. The device is not suitable for the application in a modern winder.

The fork-shaped slot is of such a preset length, in that a thread within the preset length of the fork-shaped slot, based on the position of a guiding template and with the increasing bobbin, is steadily moved deeper into the fork-shaped slot, whereat a stroke reduction of the traversing thread results, actually for the reason of the reduction of the distance between the swivel axis of the lever and the position in which the thread is being guided within the fork-shaped slot, in order to obtain cone-shaped bobbin end portions. By means of a cam disk and a lever being furnished with a feeler roller, which drive the thread guide lever via a connection rod, the movement of the arm is accelerated or decelerated respectively, towards the end portions of the bobbin. EP-B453 622 suggests a device with a thread guide and a thread guide carrier, whereat the carrier is guided in a groove. The device also comprises a drive motor and a programmable control means whereat the motor is operated with a higher current than the nominal current, while the thread guide is near a reversing point, and is operated with a current below the nominal current, while the thread guide is in the remaining zone. Basic programs for different winding sections are stored in the control means. Within the control means, the calculation of the paths, the speeds and accelerations take place for the motor movement based on the angular laws being applied. Parameters which can be stored comprise the basic stroke and the variations of the basic stoke in order to produce soft bobbin edges.

According to an exemplified embodiment being illustrated, a stepping motor operates as a drive motor between the stroke centre and a reversing point against the force of a torsion spring. Near the reversing point, the constant of the spring is increased, the power supply to the stepping motor is increased and the frequency of its control impulses is reduced. Thus it is to be stopped at its reversing point. Respective monitoring means are not provided. In the stroke centre, a detector is provided which allows the detection of possible faults at this point within the traversing stroke. A traversing stroke is always controlled from this point by means of an impulse sequence. The exact definition of the reversing points cannot be derived from the description and is most likely also not possible, since they will result from the opposing forces of the motors and the spring.

In FIG. 4 of the EP-B-556 212 (WO 92 086 64) a traversing with a thread guide at the free end of a rotatable support arm is shown. According to the main claim, the description relates to a method according to which the packing formation takes place by controlling the relation between the rotation of the winding and the speed of shifting of the thread. This is to be accomplished by an arrangement for return movement which controls the rotation of the winding. The description emphasizes the controlling of the speed of the thread shifting during a single stroke movement. Nothing is, however, mentioned about the definition of the reversing points of said movement.

From the EP-0 838 422A1 a finger- or pointer-shaped, thread guide is known which at one end is arranged drivable on a motor and which on its other end is provided with a slot to guide thread. The motor is controlled by way of a pre-programmed control means for pivoting of the pointer and thus for the traversing of the thread and the pivoting movement of the pointer is continuously monitored by means of a photo-electronic detector, whereat in case of deviations from a given motion program the pivoting movement is corrected. The detector responds to detectable markings.

In order to assist the deceleration and the acceleration of the pointer at the stroke ends, there are for instance energy storage means provided in the form of springs, on an also pivotable and drivable support, which are energized during deceleration of the pointer and which are being de-energized during acceleration of the pointer. The support is pivotable by means of a drive and the drive is controlled by way of a control means in such a way that the position of the energy storage means can be changed so that on one side the energy storage means can adapt itself to the stork to be applied, for instance for the formation of the bobbin.

The traversing according to EP-A-838 422 is designed for the laying of a thread which is being drawn off a supply bobbin. From this, a precision winding is to be formed. The photo-electronic detector that monitors the position of the pointer, relates its monitoring always to a start position of the thread guide, preferably to the zero-point of its pivoting movement. This pivoting movement takes place in that the thread guide first is moved to one and then to the other reversing point, whereby the detector counts the number of markings corresponding with the stroke and from which it calculates the zero-point. In the EP-A-838 422 it is not explained in which way the reversing points are determined. The stroke of the thread guide is defined by the stroke of the pivoting movement of the above mentioned carrier and the latter stroke is monitored by a second detector. The coordination of the movements of the carrier and the pointer is mentioned, however it is not explained. According to the description, the adjustability of the energy storage means serves in any case the purpose to enable a "simple change" of the stroke of the thread guide. For this, the arrangement of the energy storage means on the oscillating drivable carrier is to enable a change of the stroke of the thread guide by a mere change of the stroke of the carrier and without mechanical adjustment of the position of the energy storage means.

It is to be assumed that the positions of the reversing points relate to the positions of the energy storage means. The positions of the energy storage means can be influenced by way of the control means. The application DE-A-196 23 771 discloses a traversing with at least one guiding rod (FIGS. 1/2) and if applicable two guiding rods (FIG. 3/4) for the thread guide. In a variant (FIG. 1/2) the guiding rod can be formed as the stator of a linear servo motor, for which it can be furnished with magnets. In the other variant, a pivot arm is provided in order to transmit the traversing movement onto the thread guide, for which a "pivotable connection" is required between the pivot arm and the thread guide. The application DE-A-196 23 771 does not disclose anything about the definition of the reversing points. Neither does the application disclose how the servo motor is to operate.

The JP 7-165368 shows a traversing with a "linear motor". The structure of this motor or the way respectively, how it is supposed to cooperate with the thread guide, cannot be recognized from the description or seen in the illustration respectively.

The JP 7-138935 describes a linear motor, wherefrom a carriage (with a thread guide) runs back and forth along a rod, whereat the magnetic field is led through the rod. Springs are being provided at the reversing points.

JP 7-137934 describes a similar arrangement whereat the springs are being replaced by detectors which cooperate with a time controller in order to initiate the reverse movement.

The structure of the linear motor cannot be clearly recognized from the latter disclosure.

SUMMARY OF THE INVENTION

It is an object of the invention to eliminate disadvantages of the state of the art. Additional objects and advantages of the invention will be set forth in part in the following description, or may be obvious from the description, or may be learned through practice of the invention.

The task is solved in that the drive for the arm (pointer) or its support means respectively is provided with a programmable control means and that the reversing points for the stroke motion can be defined within the control means. The definition could take place by direct input of the reversing points. Preferably, however, bobbin parameters are entered from which the control means can derive the reversing points according to their programming cycle. The arrangement is defined in such a way that the controlled drive can assure the reversing at a selected reversing point. The compliance with the required reversing accuracy can be monitored by suitable detecting means and be transmitted to the control means. Approaching and moving away from a reversing point can be monitored in particular in order to recognize faults at these points. The reversing points of the arm correspond with the reversing points of the support means can thus be laid out in such a way that the oscillating movement of the thread guide provided on the arm.

The arm is being laid out with regard to form and weight in such a way, in that the motor driving the arm for a preset bobbin formation, can be accelerated and decelerated according to the preset control program. In a first preferred type of embodiment the arm is formed according to an at least first order polynom and preferably according to a second order polynom, in order to obtain a linear increasing course of the mass moment of inertia throughout the distance from the rotating axis towards the end of the pointer.

In a preferred embodiment, the cross section of the arm is of a larger dimension in the running direction than it is at a right angle to it. It is also preferred to furnish a hollow cross section over at least a preset longitudinal section of the arm and it is further preferred to fill the hollow section with filling material whose specific gravity is lower than the one of the walls of the hollow section.

It is further of advantage if the arm consists of several parts, in that preferably at the thread guiding end of the arm a thread guiding element is either inserted or otherwise attached to the arm.

Furthermore it is of advantage to manufacture the arm at least partially of carbon fiber composite material. Beyond that, it is preferred to divide the arm into a supporting part and a part at which a thread guiding part is provided. The supporting part can be manufactured as a sandwich type or as hollow profile part, whereat also an (outer) shell of the supporting part can be assembled from separately formed elements.

Due to the favorable design of the arm and the drive, a possible application of said arm exists in the circumstance, in that the arm can lay the thread within the stroke zone with a variable stroke length and outside the stroke zone it can fulfil specific functions, for instance the function of drawing-in and the bobbin replacement, in that the arm can be positioned outside the stroke zone in such a way that the arm can be stopped at one position for the catching of the thread in a catching slot or a catching knife on the bobbin tube or bobbin arbour and for the formation of a reserve bunch on a bobbin tube end. Furthermore the arm can also be stopped within the stroke zone for the formation of an end build-up on the finished bobbin.

The oscillating rotating movement of the holding means includes preferably a predetermined turning angle of between 45° and 90°, for instance 60°. The length of the arm can be selected in dependence of the desired stroke width.

In the following the invention is being further explained in more detail by way of the exemplified embodiments in the accompanying drawing; wherein show:

DETAILED DESCRIPTION

Reference will now be made to the invention shown in the figures. Each embodiment is provided by way of explanation of the invention, and not as a limitation of the invention. It is intended that the invention include modifications and variations to the embodiments described and shown herein.

Figure 1:
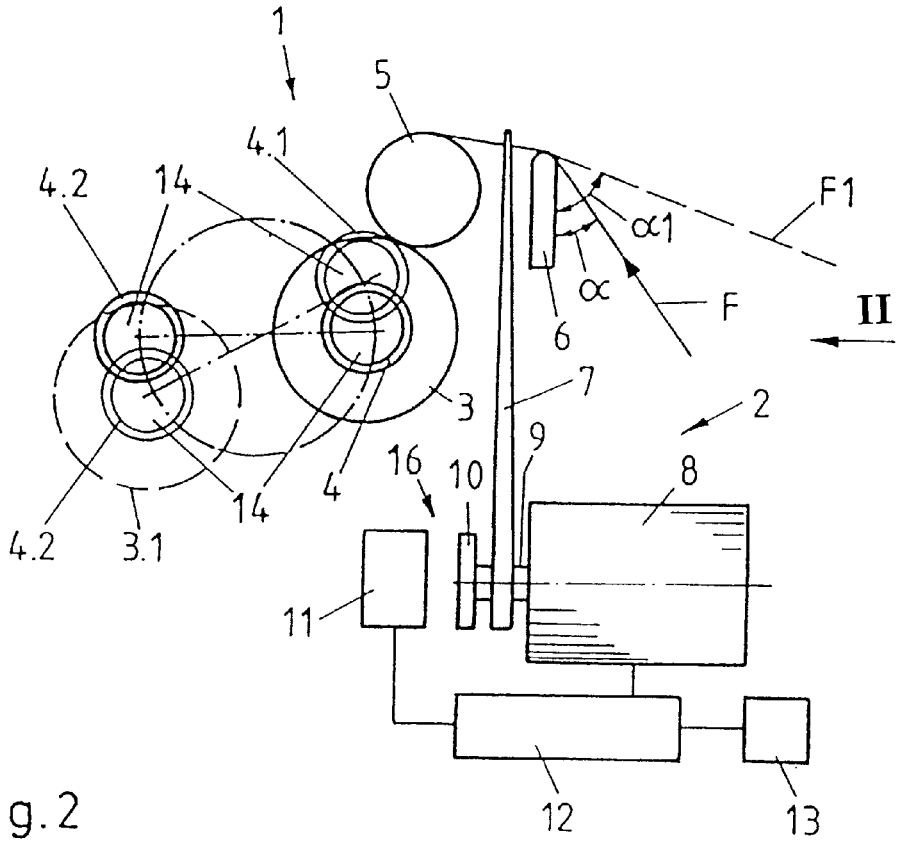
FIG. 1 a winding machine with an arm according to the invention and an application of the arm according to the invention, each shown schematically, FIG. 2 the winding machine according to FIG. 1 seen in the direction II in FIG. 1, FIG. 3 the view of FIG. 2, however, additionally with a diagram of the course of speed of the arm during the stroke movement being transmitted by a control means, FIG. 4 a further variant of the view of FIG. 2, also additionally with a diagram of the course of speed of the arm during the stroke movement being transmitted by a control means, FIG. 5 a diagram for the explanation of the programming of the motor control in a variant according to FIGS. 1, 2, 3, or 4, FIG. 6 a schematic layout of a pointer according to the invention, FIG. 7 a cross section of a first variant of a pointer according to FIG. 6, FIG. 8 a cross section of a second variant of a pointer according to FIG. 6, FIG. 9 a diagram for the explanation of certain winding parameters which can be entered into the control means, FIG. 10 a diagram for the explanation of an example for the utilization of the capabilities of the new traversing, and FIG. 11 in the sketches 11A, 11B, and 11C three different variants of the thread guide, and FIG. 12 in the sketches 12A, 12B, 12C and 12D four different variants of the connection between the arm and the drive motor.

FIG. 1 shows a schematic cross section through a winding machine 1, in which by means of a traversing device 2 a thread F is built-up to form a bobbin 3. The bobbin 3 is formed on a bobbin tube 4 which is carried by a bobbin arbour 14.

The drive of the bobbin 3 either takes place over a drive of the bobbin arbour 14 (not shown) or by way of a friction roller or a contact roller 5. The friction roller or the contact roller (in case of a driven bobbin arbour) additionally has the function to take over the thread from a traversing thread guide, here called pointer 7. The pointer 7 is arranged between or in front of a guiding template 6 and the friction roller or tacho roller 5 respectively, whereat the guiding template 6 for instance is being laid out is the way according to the following FIGS. 2, 3 and 4 respectively.

The bobbin 3 with the bobbin tube 4 is shown in operating position, whereat additionally an empty tube 4.1 is shown at the beginning of a bobbin formation thereby contacting the friction roller or tacho roller 5 respectively, while with the numerals 4.2 empty bobbin tubes are shown in a waiting position. These two waiting positions are the starting positions for a rotary movement indicated with a dotted line of the so called revolving drive, by means of which the empty bobbin tubes are moved to the friction roller or the full bobbin 3.1 is moved away from the friction roller respectively into a doffing position.

The pointer 7 with its larger shaped and, relating to its weight, heavier end is fixedly connected on a motor shaft 9 or a motor 8, for instance according to FIG. 12A–12D, whereat the motor 8 is controlled according to a stroke program for the formation of the bobbin. The input of such a program into the control means is done via the input unit 13.

For controlling the movement of the pointer 7, a motion monitor 16 is provided, consisting of a signal transmitter 10 fixedly connected with the motor shaft 9 and a separately arranged signal receiver 11, which transmits the received signals to the control means 12.

Figure 2:
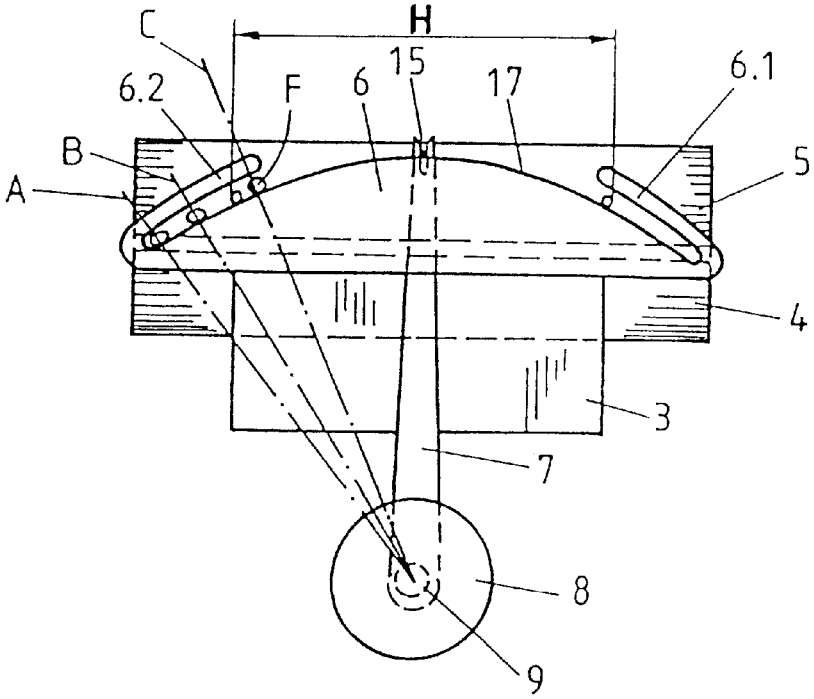
Figure 3:
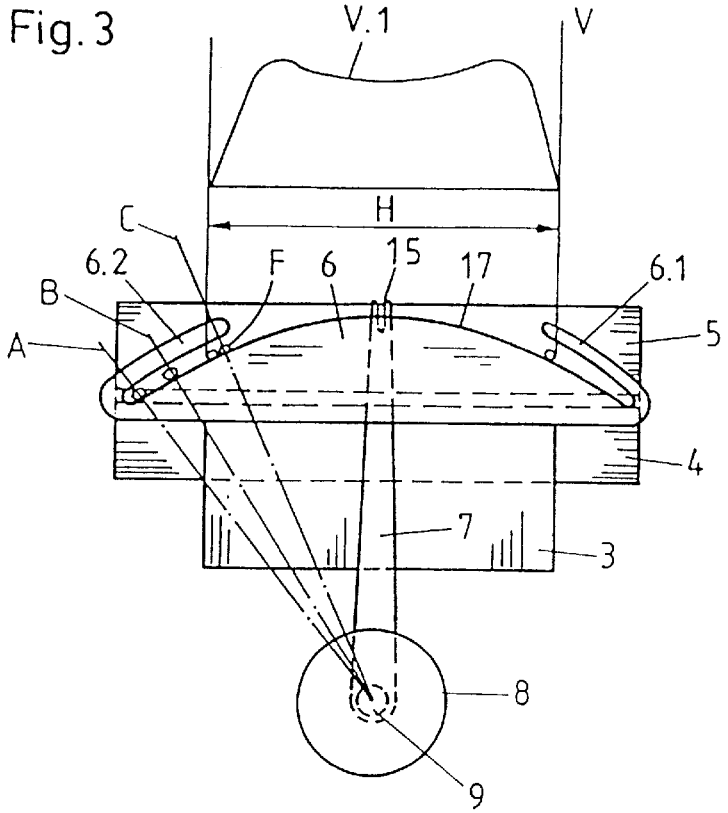
Figure 4:
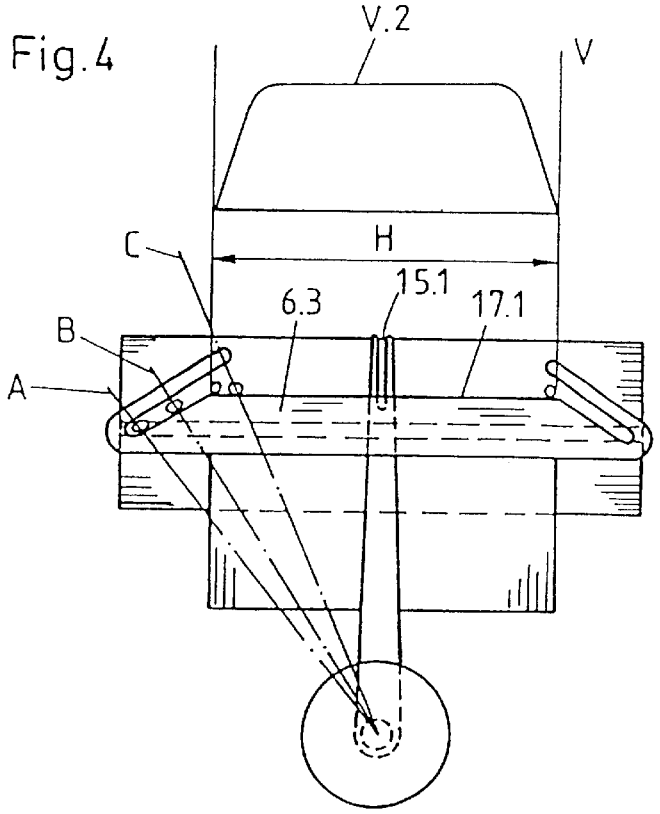

According to the layout of the guiding template 6, as this indicated in the FIGS. 2 and 4, the thread F can be applied at an engaging angle $\alpha$ or $\alpha 1$, whereat said engaging angles are to be applied in such a way that the thread F can never be lifted off the guiding template, with the exception however, that the guiding template is furnished with a counter guide edge 6.1 or 6.2 respectively, as is being shown in the FIGS. 2 to 4, which guide the thread in such a manner that the thread can never be lifted out of the guiding slot 15 or 15.1 respectively, of the pointer 7.

The layout of the guiding template 6, including the layout of the counter guide edge 6.1, 6.2 respectively, is to be carried out depending on the arrangement of the guiding template in relation to the pointer 7 and the friction roller or the tacho roller respectively, i.e. the layout of the guiding template 6 is not limited to the illustrations of the FIGS. 2–4.

The course of the thread according to the engaging angle $\alpha$ is marked with F1 and the running direction of the thread according to the engaging angle $\alpha$ is marked with F. The selection or the necessity of the corresponding location depends on the previously mentioned layout of the guiding template or vice versa.

FIG. 2 shows the winding machine 1 in viewing direction II of FIG. 1, whereat for simplicity reasons the input unit 13 and the control means 12 are omitted. FIG. 2 is to illustrate in the first place, that the pointer 7 may not only be moved back and forth within the stroke zone H but that on one side the thread F can be stopped, for bobbin replacement, by way of the pointer 7 at the position C, in order to form a so called end build-up on the finished bobbin.

Furthermore, the pointer 7 can be stopped at the position A and B outside of the stroke zone H, that is for drawing-in of the thread at the beginning of a winding process or during bobbin replacement. Thus, on one hand the pointer 7 can be stopped at the position A in order to keep the thread in a position in which said thread can be caught by catching knife or bobbin tube notch of a succeeding bobbin tube, and on the other hand at the position B which serves the purpose to keep the thread on the new bobbin tube in a position, in which the thread can form a reserve bunch on the bobbin tube end. Thereafter the thread F is guided into the stroke zone H by the pointer 7 and further traversed back and forth within the stroke zone.

From this, it can be seen that the pointer in said variant cannot only de decelerated or accelerated respectively at the ends of the stroke zone without external assistance, but that the pointer can be brought into position very fast, within which position it remains for a moment at stand-still in order to thereafter again be shifted or accelerated respectively at high speed into a further function zone.

FIG. 3 shows additionally a course of speed of the pointer 7. This indicated course of speed differs in relation with each of the types of bobbin formation, therefore the shown course of speed does not represent a limitation for the possible course of speed of the pointer 7.

FIG. 4 shows a variant of a guiding template 6 which in relation to the guiding template 6 of FIG. 2 and 3 differs in such a way, in that on one side the guiding template 6.3 is provided with a straight guiding path 17.1 and in that on the other side the thread F is guided in a lengthened guiding slot 15.1 of the thread guide 7. Thereby it is also possible, depending on the type of bobbin formation and on the course of the traversing speed and the arrangement of the friction roller or tacho roller 5 respectively in relation to the pointer 7 and in relation to the guiding template 6, to provide other forms of guiding templates.

For an optimized layout of the bobbin, there exists furthermore the possibility to select, on the base of the control means, a variable turning angle reversing point for the pointer.

Figure 5:
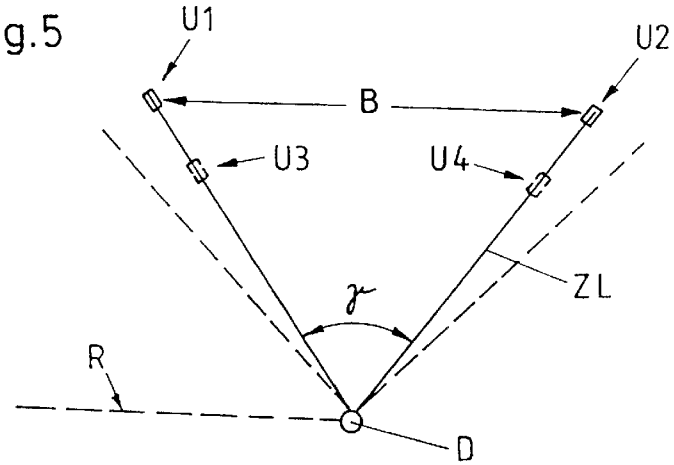

FIG. 5 shows diagrammatically the revolving axis D of the pointer 7 and the reversing points U1, U2 of a defined traversing movement of the thread guide 15 with stroke length B. The longitudinal axis ZL of the pointer 7 has to be pivoted around the axis D over an angle $\gamma$, in order to generate the traversing movement. Said movement can be programmed into the control means 12, whereat the reversing points for instance are defined in relation to a reference line R. The detector 10 (FIG. 1) or the evaluation means in the control means 12 respectively, can be laid out in such a way that the motor 8 reverses its turning direction by way of the control means at a preset reversing point (U1 or U2 respectively). The actual position of the pointer 7 is always known by means of the motion monitor 16 and can be compared by the control means 12 with the preset reversing points in order to allow reversing at the respective desired position.

The preset reversing points U1, U2 can be altered (within preset limits) via the input unit 13, as will be explained in more detail in the following. This is indicated schematically with the dotted lines in FIG. 5. The rotary speed of the arm at the best has to be altered, for instance if the linear speed of the thread guide has to remain constant. For instance a bobbin formation cycle can also be entered, by which it is possible to alter the stroke during bobbin formation. The formation cycle also includes for instance the definition of a thread catching position connected with it, as has been described. The input can for instance take place based on preset winding parameters. The operator will for instance be requested by the control means 12 to enter the necessary parameters before a winding cycle can be started.

Figure 6:
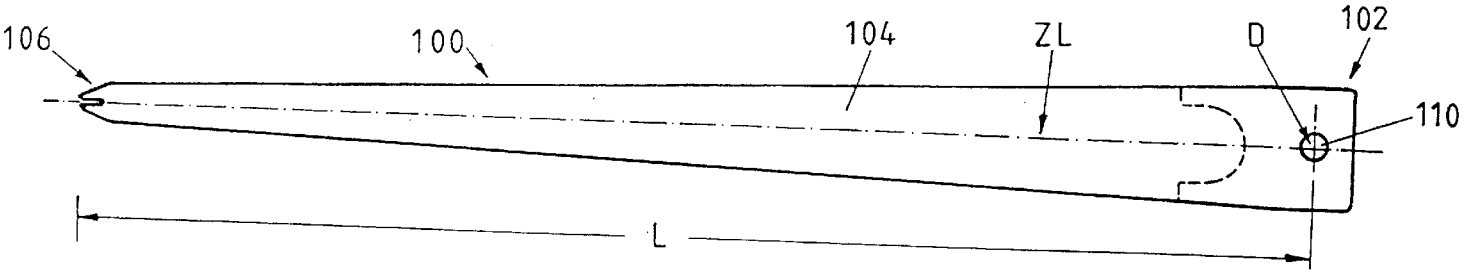

The FIGS. 1 to 5 therefore represent a first variant, according to which the reversing at preset reversing points U1, U2 (however, possibly also at other points) is accomplished by the motor and without additional assistance. FIG. 6 shows a variant according to which assisting means are being provided, however, whereat the reversing points are still determined by the programmed control means. The arrangement according to FIG. 5 forms therefore a home position also for the variant according to FIG. 6, whereat certain differences will become clearer during the further description.

FIG. 6 schematically shows a pointer 100 for the application in the embodiments according to the other figures. The pointer 100 comprises a fastening portion 102, a middle part 104 and a thread guide 106 at the free end. Starting from the rotary axis D, the pointer 100 has a length L up to the free end of the thread guide 106. From FIG. 5 it can be seen that at a preset rotary angle γ said length is of importance for the stroke width B. If for instance the length of the pointer of FIG. 5 were shortened, the reversing points would for instance lay at U3 or U4 respectively and would result in a correspondingly reduced stroke width (not specifically indicated). Principally a pointer pertaining to a certain traversing unit could be replaced by a shorter (or longer) pointer, in order to adapt the stroke width to the requirements. Normally it is however preferred to keep the respective pointer length of a certain traversing unit unchanged and to instead utilize the flexibility of the programming for the stroke changes. Thereby different traversing units (for instance for winding machines with different numbers of threads) can be furnished with different pointer lengths. Principally, it is also possible to individually program the maximum turning angle of different traversing devices (and to adapt the geometry of the elements accordingly). Preferably a preset programming (geometry)—or at least only a few variants—are provided.

Preferably the length L amounts to between 10 and 50 cm and the turning angle γ between 40° and 100°, preferably 45°–90°.

Figure 7:
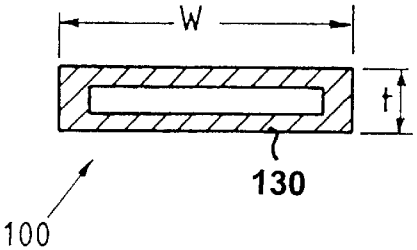
Figure 10:
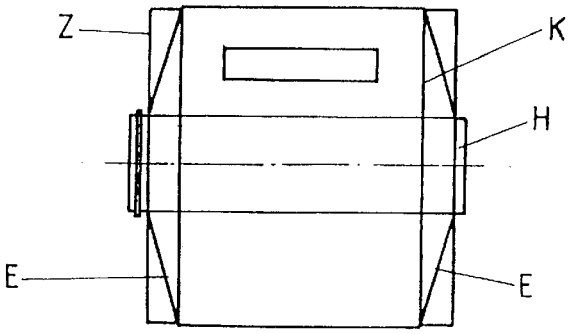
PRIOR ART Fig.10

FIG. 7 shows a possible cross section of the pointer 100 at any position in the middle part. In this variant the pointer is made as a hollow body 104 with a width W (at the mentioned position) and a "depth"t. the depth t is preferably constant over the length of the pointer 100. From FIG. 10 it is clear that the width W is considerably larger than the depth t and this also applies over the whole length of the pointer 100. The hollow body should be formed from a rigid but light material, preferably of fiber-reinforced plastic (shown as cross-hatched material in FIG. 7). The fibers preferably have a high e-module (for instance carbon fibers, boron fibers or aramide fibers).

Within the fastening section 102, the pointer is provided with a reinforcement 108 (FIG. 6), for instance made of metal. The reinforcement 108 in this example for instance has a U-shaped attachment (not specially indicated), which extends as an insert into the hollow body 104 and which therein is being connected with the hollow body 104 (for instance by means of an adhesive). The metal part is provided with a receptacle 110 for the shaft 44 (FIG. 6) of the drive motor.

The U-shaped attachment is not essential, however, the connection between the portion 102 and the hollow body 104 should ensure secure transmission of the drive forces (moments of rotation) onto the hollow body, in fact it should be reliably throughout the operating life of the hollow body 104.

Thread guide 106 is also preferably made as a separate part and connected with the hollow body, whereat a part of the thread guide provided with a slot remains free. Said part can for instance be made of ceramic.

The hollow body 104 (FIG. 7) in the form of a rectangular profile can for instance be formed as a wound body. A winding process (for a larger body) is shown schematically in EP-A-894876—for the formation of the profile 104 it can be adapted. As an alternate variant the hollow profile 104 could for instance also be formed from two shell parts, which are connected with each other (for instance with an adhesive) in order to form a hollow body assembly. Each shell part could for instance be formed as a U-profile of low depth, whereat the side walls of said shell parts are being connected with one another to make-up the hollow body.

FIG. 6 clearly shows section of the pointer 100 changes over the length L, in fact preferably as a function of the distance measured from the rotary axis D. FIG. 6 shows a pointer with a linear relation between the cross section of the pointer and this distance, whereat a quadratic relation is actually preferred. Since the depth t is preferably constant, the cross section change expresses itself in a change of the width W.

Figure 8:
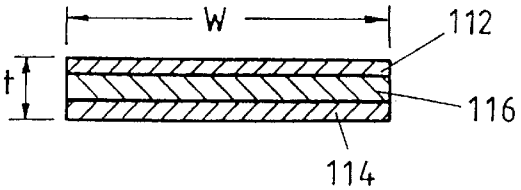

FIG. 8 shows a modified cross section whereat the dimensions W and t in comparison with FIG. 7 are unchanged. The pointer 100 in this variant comprises a first plate 112, a second plate 114 and a filler layer 116 in between, which is being connected with the plates for instance by adhesive. The end parts (fastening section 102 and thread guide 106) can be similar to the parts already described.

The above description relates to reversing points for the arm or the pointer respectively, because said points are of special importance for the actual functioning. The control means, however, does not relate directly to the momentary position of the arm but to the one of the motor shaft, which serves as a holding element for the pointer. The control means is therefore programmed based on the reversing points for said holding means (for the shaft), which are being reflected in the already described reversing points for the arm.

The momentary angular position of the shaft (holding means) can be indicated by a rotary transducer. Said rotary transducer can be an incremental type transducer or absolute type rotary transducer. In the case of an incremental transducer, the system has to be moved to a referential point during start-up, from which referential point the incremental transducer then "counts" the position changes. It might be necessary that from time to time a movement back to this referential point has to be initiated in order to control the system condition and if necessary to correct it. With such an installation a thread laying accuracy of for instance +/−0.25 mm can be achieved. With an absolute value transducer such a "calibrating" procedure is not required.

Different (for instance non-contacting) detectors can be applied for referencing of the rotary transducer. Examples are optical, pneumatic, electrical and inductive (magnetic)

detectors. A signal transmitted by the detector, which indicates the "presence" of the arm near it, can be transmitted to the control means and evaluated therein, in order to give a reference for the positioning system. In an alternative, the arm can be put into contact with a mechanical stop, whereat the corresponding outgoing signal of the encoder can be evaluated in order to give a reference for the positioning. This step should be carried out as a specific referencing step, whereat the motor generates a low moment of rotation, in order to accomplish a non-damaging contact between the arm and the stop.

The reference detector or the stop respectively can be located outside of the maximal stroke zone, since the motor is able to move the arm outside of this zone, for instance for the above-mentioned referencing step. The reference detector or the stop respectively could, however, also be located within the stroke zone. In the latter case, the stop has to be removed from the moving path of the arm before the actual traversing movement takes place. For this, the stop can be moved for instance rectangular or at least angularly in relation to the traversing level between a stand-by position outside the traversing level and an operating position at the traversing level, for instance by means of a cylinder-piston unit.

The programming of the control means consists of a "fixed preset" part, which cannot (or should not) be influenced by the end user, and of a part being required for the user, which preferably consists of certain winding parameters. A nominal stroke width is preferably included with fixed preset program part, where the effective stroke width (the laying length) for a defined stroke is calculated by the control means based on the winding parameters entered by the user. The following winding parameters can for instance be entered:

Crossing Angle

Figure 9:
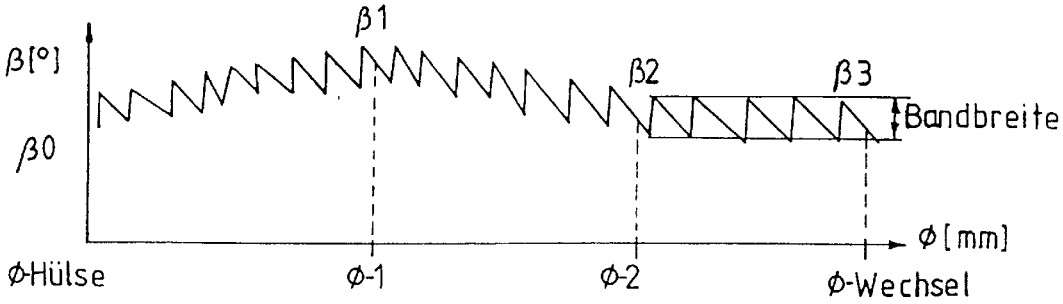

The crossing angle defines the (average) traversing speed based on the actual winding speed. FIG. 9 shows schematically the change of the crossing angle course during the bobbin journey, whereat the illustration corresponds with FIG. 8 from EP-B-629174.

Band Width

The band width defines the deviation by which the preset crossing angle may vary (FIG. 9), as far as a step precision winding is desired (see FIG. 8 in EP-B629174). The deviation from the average crossing angle of the band is for instance 0 to 3°.

Fraction Table

The fraction table contains the fractioned parts of the reliable winding conditions (see for instance U.S. Pat. No. 5,605,295). Selected winding ratios can for instance be stored as a formula in the control means of a winding machine.

Stroke Breathing

With the stroke breathing, a periodical change of the laying length is defined. In this case also formulas can be stored.

Stroke Course

The stroke course defines the laying length along the bobbin journey. Four support points are for instance arranged per laying length.

Unit: % (of the normal stroke width), zone: 18–120%. In this zone, a nominal stroke (=100%) is entered in the software. The change can then for instance only be made between 80–120%. If for instance a nominal stroke=250 mm is defined, then it can be traversed between 200–300 mm. The stroke width can then be selected constant throughout the bobbin journey, or a course (for instance depending on diameter) can be entered (similar to the course of the cross angle). Superimposed on this, the stroke width can change via the stroke breathing (similar to step precision winding or wobbling over the crossing angle course).

The course of an operating parameter (for instance crossing angle or stroke course respectively) could be defined as a function of time or of another parameter correlating with the bobbin formation. The horizontal axis in FIG. 9 would have to be adapted accordingly. A variable course could in particular be defined as a function of the number of strokes of the traversing unit, whereat the number of strokes could be defined from the beginning of the bobbin travel or from a foregoing support point.

In the control means different "traversing formulas" can be programmed permanently (permanent does not necessarily mean not variable, but merely they cannot be influenced by the operator when entering winding parameters). The operator can then call-up one of the formulas and "link" it with the entered winding parameters for the formation of specific bobbins.

The stroke width should optimally include the bobbin tube length (package volume=max). If for technological reasons, however, (for instance because of extreme bulging) a narrower package can be wound without bulgings protruding beyond the bobbin tube edge, then this can be of advantage for the transport. For this the capabilities of the new type of traversing can be utilized, which can be built-up onto the tube H with the conventionally known types of traversing. The axial length of said core package K is considerably shorter than the bobbin tube length H, because the expected bulging will effect a protrusion of the core up to the permissible limits. By way of the type of traversing according to the present invention, at least a package with bi-conical ends E can be formed, since the stroke length can be changed during the bobbin travel. Thus more thread material can be wound per bobbin tube, without having to influence the bobbin formation by means of a specific laying algorithm. With the full utilization of the capabilities of the new type of traversing, i.e. during controller laying of the thread within the individual traversing strokes, it is however possible at most, to form a cylindrical package Z with the maximal permissible axial length. In a proved winder (see for instance U.S. Pat. No. 5,794,868 or U.S. Pat. No. 5,553,686) normally several threads next to each other are wound onto a single bobbin arbour to form a package each. According to the invention, for each package, a traversing unit (with a pointer) has to be provided. It is however not exclusively necessary to provide an individual motor for each pointer, even though this is obviously possible. Instead for all traversing units a common motor can be furnished, whereat the rotary movements of the motor shaft are transmitted to the respective traversing unit by way of a suitable transmission (for instance a belt). The transmission is preferably of such a reliable type, that it is not necessary to furnish a monitoring means for each of the units, i.e. there is also only one servo-regulator provided for the central drive. If the transmission distance becomes too long, then the drive can take place "in groups", i.e. for one group (two or more) of neighboring units, a common drive can be provided.

Figure 11A:
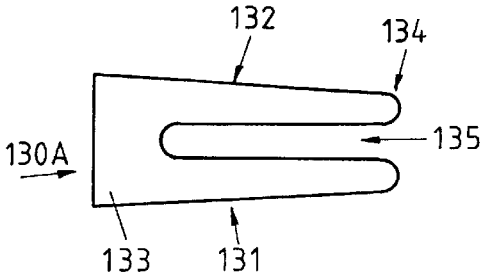
Figure 11B:
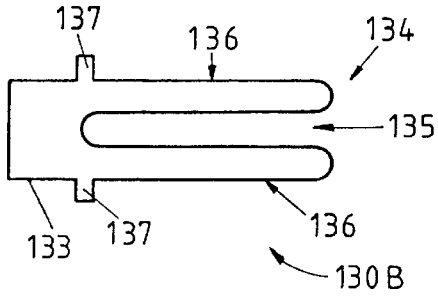
Figure 11C:
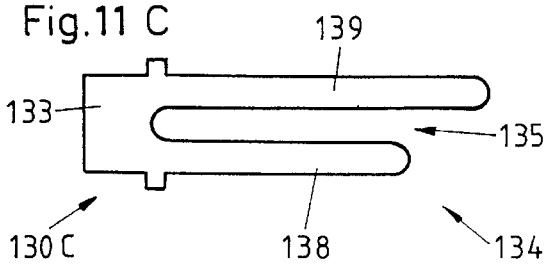

FIGS. 11A–11C refer to suitable embodiments of the thread guide. The preferred design comprises a form-closed connection between the thread guide and the arm (pointer). FIGS. 11A and 11B show two possible variants. The first variant (FIG. 11A) comprises an oblong body 102A with tapered in longitudinal direction lateral surfaces 131, 132, which surfaces result in a relatively wide foot part 133 and a narrow head 134. The foot part 133 is received by the arm (not shown), so that the head part 134 can extend freely. The head part 134 has a longitudinal slot 135, which opens towards the free end of the thread guide. The variant according to FIG. 11B is also provided with a foot part 133 and a head 134 with a longitudinal slot 135. The body 130B, however, has parallel extending side surfaces 136, which in the zone of the inner end portion of the slot 135 are furnished with a protrusion 137 each. Therefore, in this case the head width is the same as the foot width, however, the body 130B may also be furnished with tapered lateral surfaces. The foot part 133 of the body 130A or 130B respectively is mounted or embedded respectively, in such a way that the protrusions 137 and/or the tapered side surfaces 131, 132 together with the arm form the desired form-closed connection.

FIG. 11C also shows a thread guide in the form of an oblong body 130C with a foot part 133 (similar to the foot part in the variant according to FIG. 11B), a head 134 and a longitudinal slot 135. The branches 138, 139 formed by the slot 135, however, in this case are not of the same lengths, which facilitates the threading of the thread guide when moving the arm in one of its rotary directions.

The thread guide can be manufactured from a suitable material, for instance $Al_2O_3$ or SSic. It is however, principally possible to manufacture the body 130 from another expensive material and to provide it with a suitable coating. The coating material has to meet two requirements, that is (1.) to provide a surface which causes only slight friction between the thread and the thread guide, and (2.) it has to provide a high resistance against wear, since the thread generates a highly abrasive effect during high speed winding (for instance>4000 m/min., preferably>6000 m/min for instance up to approximately 10,000 m/min.). The coating material or the material of the body, in case that no coating is applied, therefore has to be hard and tenacious. Suitable coating methods are for instance galvanic coating or plasma coating.

The thread guide should be formed of a most possible low mass. Its length is therefore kept as short as possible, whereat a reduction beyond a certain limit, is hindered by the required function. The body 130 therefore has preferably a small thickness (compare dimension "t" in FIGS. 6 and 7), i.e. rectangular to the plane of the illustration in the FIGS. 11A to 11C. The preferred thickness of the body 130 is thus within the range of 0.2 to 1.5 mm, preferably approximately 0.6 mm.

In order to keep the friction between the thread and the body 130 at a minimum, the body 130 can have rounded edges within the zone of the slot 135 or these edges may merely be broken.

In order to securely connect the thread guide with arm, an additional fastening material can be applied, for instance an adhesive or a screw. The connection can be produced during manufacturing of the arm, i.e. the thread guide can be integrated during assembly or forming process of the arm, or the thread guide can be connected with the arm only afterwards, i.e. after the arm itself has been manufactured.

The thread guide can be embedded in the holding arm in such a way that it is supported. Thus it is prevented that the thin ceramic plate breaks. The larger surface for applying adhesive or the connecting surface respectively, furthermore provides good distribution of forces. It is not essential for the invention to form the thread guide separately and to fasten it on the arm. A thread guiding slot could be formed directly on the arm itself. The necessary protection against wear could be guaranteed by way of a suitable coating.

Figure 12A:
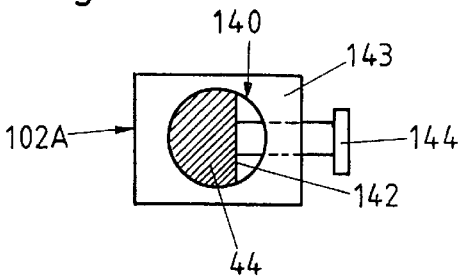

On the other end of the arm of the thread guide, a connection needs to be provided with the drive shaft of the motor. This connection is important because the capability of the motor, to exactly define the position of the thread guide, depends on the accuracy of the transmission of the movements of the motor shaft onto the arm. For this case as well, preferably a form-closure type of connection is being established. FIG. 12A shows an end part 102 (see FIG. 6) which is provided with a through hole 140 in order to receive the free end of the motor shaft 44. For this purpose the end part of the shaft 44 has a flat portion being ground onto one side in order to form the surface 142. A side wall 143 of the part 102 has a thread hole (not specially indicated) to receive a fastening screw 144, whereat the front end of the screw presses forcedly against the surface 142 or protrudes into a hole (not shown) of the shaft end respectively.

Figure 12B:
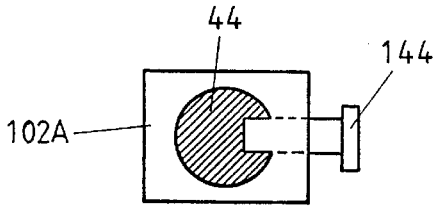
Figure 12C:
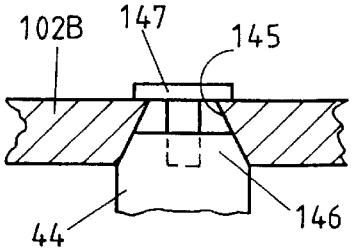
Figure 12D:
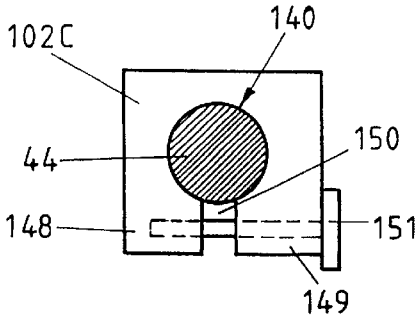

FIG. 12B shows a similar variant, whereat the grinding on one side of the shaft end is omitted. The screw 144 works together with a thread hole (blind hole) or key slot in the shaft end. FIG. 12C shows an end part 102B in a cross section. Said part is provided with a tapered hole in order to receive a tapered portion 146 of the free end of the shaft 44. A clamping screw 147 clamps the end part 102B fixedly onto the shaft end. FIG. 12D shows an end part 102C with a slot 150 extending through to the hole 140, thereby forming two elastically deformable branches 148 and 149 respectively. A tension bolt 151 can be provided in order to force the branches toward one another and thus to generate a force-locked clamping connection with the shaft end resting in the hole 140. The clamping force connection may possibly not suffice over the length of time. It can therefore be supplemented by additional form-closure means, for instance by longitudinal ribs on the shaft end (not shown), which project into corresponding grooves in the end part 102.

The end part 102 has preferably a low inertia of mass. It can therefore be made of a light metal alloy (Al-alloy). As in the case of thread guide, it can be integrated during manufacturing into the carrier arm or it can be embedded afterwards by means of for instance adhesives.

As has been mentioned at various points of the above description, with a type of traversing according to the invention, by means of suitable programming, many types of packages can be realized, which have up to now only been achieved with more or less extensive adjustments of the machine itself (by the replacement of the traversing). Examples are:

- the different conventional winding types (wild windings, precision windings and step precision windings);
- the different conventional package forms (cylindrical, conical, biconical)
- stroke changes such as stroke reduction, stroke shifting and "stroke breathing".

The term stroke breathing relates to an intermitting or periodical shifting of one or both reversing points of a traversing stroke. The principle is well known to the expert and has also been realized often, however, generally with considerable mechanical complexity—see for instance U.S. Pat. Nos. 5,275,843; 4,555,069, EP 27173 and EP 12 937. The capability of the now presented type of traversing, to program the stroke characteristics for of the now presented type of traversing, to program the stroke characteristics for single layers or at least for single layers of the package respectively, makes it now possible to realize stroke breathing also in a high speed winder and without intervention, in the normal thread guidance.

In connection with design of the machine itself it is important to provide a simple structure, which however, is based on the optimal utilization of modern materials (low mass design) and control principles (digital servo regulators). This way, it is possible to connect the thread guide directly with the motor, so that the movements of the rotors can be transmitted to the thread guide without transmission gear, whereby the high dynamic requirements of the traversing for a high speed winder can still be met. In this connection it is of importance that there are no "additional" frictional forces between the thread guide and a guiding means for said "thread guide". Providing or mounting respectively of the thread guide on a carrier (arm) which itself does not require additional guidance (i.e. which itself comprises the required rigidity at a low mass moment of inertia), enables a considerable improvement of the dynamic capabilities of the system.

Nevertheless, it is possible that the exact maintenance of the predetermined reversing points (without the application of an "over-dimensioned motor") can lead to difficulties so that at least for certain applications one has to expect for instance an exceeding of the reversing points. In such cases the faults can be measured, since the angular position of the arm or of its holding means respectively, is known at all time and the motor control means can be arranged in such a way that the fault can be compensated as far as possible by changing the stroke characteristics. The excess movement, with the respective measurement of the fault and with the succeeding compensation of the fault, is accordingly contained in the claims as the "maintenance of preset reversing points".

It should be appreciated by those skilled in the art that various modifications and variations can be made to the embodiments of the invention described and shown herein without departing from the scope and spirit of the invention as set forth in the appended claims.

What is claimed is:

1. A thread traversing device, comprising:

a traversing arm, and a holding device to retain said arm as it moves in a back and forth motion between defined reversing points;

a drive mechanism connected to said holding device to rotate said holding device relative to a turning axis;

a programmable control system in operable communication with said drive mechanism, said control system including a detecting device disposed to detect the angular position of said traversing arm; and wherein said control system calculates the position of said reversing points at least in part by winding parameters input by a user and controls said drive mechanism as a function of the angular position of said traversing arm detected by said detecting device in relation to said calculated reversing points so that said traversing arm is pivoted back and forth between said calculated reversing points in a traversing zone, said calculated reversing points being non-physically defined by stop devices engaging against said traversing arm such that the location of said reversing points is variable by said control system without the necessity of changing or reconfiguring any such stop devices.

2. The device as in claim 1, wherein said control system variably defines said reversing points for preset zones for carrying out respective functions in said preset zones.

3. The device as in claim 1, wherein said control system is further configured to move said traversing arm beyond said traversing zone in a controlled manner for carrying out a preset function.

4. The device as in claim 1, wherein said traversing arm is formed according to a polynomial function of at least the first order wherein said traversing arm is narrowed from an end retained by said holding device to a free end so as to optimize strength and mass of said traversing arm over its length.

5. The device as in claim 1, wherein said traversing arm has a cross-sectional width, as measured in a plane of movement of said traversing arm, greater than it cross-sectional depth, as measured in a plane perpendicular to said plane of movement.

6. The device as in claim 1, wherein said traversing arm comprises a thread guiding element mounted to an end thereof.

7. The device as in claim 1, wherein said traversing arm comprises a thread guiding element formed integrally in an end thereof.

8. The device as in claim 1, wherein said traversing arm comprises a thread guiding element at an end thereof, said thread guiding element formed of a material having a higher abrasion resistance as compared to material forming the remaining portion of said arm.

9. The device as in claim 1, wherein said traversing arm is formed at least partially by a carbon fiber composite material.

10. A thread traversing device, comprising:

a traversing arm, and a holding device to retain said arm as it moves in a back and forth motion between defined reversing points;

a drive mechanism connected to said holding device to rotate said holding device relative to a turning axis;

a programmable control system in operable communication with said drive mechanism, said control system including a detecting device disposed to detect the angular position of said traversing arm;

wherein said control system is configured to define said reversing points and control said drive mechanism as a function of the angular position of said traversing arm detected by said detecting device so that said traversing arm is pivoted back and forth between said defined reversing points in a traversing zone;

wherein said traversing arm has a cross-sectional width, as measured in a plane of movement of said traversing arm, greater than it cross-sectional depth, as measured in a plane perpendicular to said plane of movement; and wherein said traversing arm comprises walls defining a generally hollow zone over a length of said arm.

11. The device as in claim 10, further comprising a filling material in at least a portion of said hollow zone, said filling material having a specific gravity less than that of said walls.

12. A thread traversing device, comprising:

a traversing arm with a thread guiding element provided at one end thereof, and a holding device to retain the opposite end of said arm as it moves in a back and forth motion in a traversing zone between defined reversing points;

a drive mechanism connected to said holding device to rotate said holding device relative to a turning axis;

a programmable control system in operable communication with said drive mechanism, said control system including a detecting device disposed to detect the angular position of said traversing arm;

said control system configured to determine said reversing points and control said drive mechanism as a function of the angular position of said traversing arm detected by said detecting device so that said traversing arm is pivoted back and forth between said defined reversing points; and wherein said control system is further configured to move said traversing arm beyond said traversing zone in a controlled manner without physically reconfiguring components of said traversing device so that a thread carried by said traversing arm is moved beyond said traversing zone for carrying out a preset function.

13. The device as in claim 12, wherein said reversing points are variably adjustable by said control system.

14. The device as in claim 12, further comprising a guiding template disposed relative to said traversing arm for guiding a thread carried by said thread guiding element, said guiding template comprising a shape to guide the thread in a predetermined path within and beyond said traversing zone.

15. The device as in claim 12, wherein said control system comprises stored control programs for at least one of bobbin formation, drawing-in, and bobbin replacement.

16. A thread traversing device, comprising:

a traversing arm with a thread guiding element provided at one end thereof, and a holding device to retain the opposite end of said arm as it moves in a back and forth motion in a traversing zone between defined reversing points;

a drive mechanism connected to said holding device to rotate said holding device relative to a turning axis;

a programmable control system in operable communication with said drive mechanism, said control system including a detecting device disposed to detect the angular position of said traversing arm;

said control system configured to determine said reversing points and control said drive mechanism as a function of the angular position of said traversing arm detected by said detecting device so that said traversing arm is pivoted back and forth between said defined reversing points;

wherein said control system is further configured to move said traversing arm beyond said traversing zone in a controlled manner so that a thread carried by said traversing arm is moved beyond said traversing zone for carrying out a preset function; and wherein said traversing arm is moved beyond said traversing zone and stopped by said control system for drawing-in the thread for bobbin replacement.

17. The device as in claim 16, wherein said traversing arm is stopped by said control system beyond said traversing zone at a first position relative to a bobbin for catching a thread with a thread-catcher disposed at the bobbin, and at a second position closer to said bobbin for forming a reserve bunch after the thread has been caught.

18. A thread traversing device, comprising:

a traversing arm with a thread guiding element provided at one end thereof, and a holding device to retain the opposite end of said arm as it moves in a back and forth motion in a traversing zone between defined reversing points;

a drive mechanism connected to said holding device to rotate said holding device relative to a turning axis;

a programmable control system in operable communication with said drive mechanism, said control system including a detecting device disposed to detect the angular position of said traversing arm;

said control system configured to determine said reversing points and control said drive mechanism as a function of the angular position of said traversing arm detected by said detecting device so that said traversing arm is pivoted back and forth between said defined reversing points; and wherein said control system is further configured to move said traversing arm beyond said traversing zone in a controlled manner so that a thread carried by said traversing arm is moved beyond said traversing zone for carrying out a preset function; and wherein said control system stops said traversing arm within said traversing zone for forming a thread build-up on a finished bobbin.

* * * * *